United States Patent [19]

Reuters

[11] Patent Number: 4,795,183

[45] Date of Patent: Jan. 3, 1989

[54] BRAKE FOR INSTALLATION ON A SNOW SKI

[76] Inventor: Karl-Josef Reuters, Hans-Böckler-Str. 9, 5180 Eschweiler, Fed. Rep. of Germany

[21] Appl. No.: 939,638

[22] Filed: Dec. 9, 1986

[30] Foreign Application Priority Data

Dec. 12, 1985 [DE] Fed. Rep. of Germany ..... 3543829
Nov. 27, 1986 [EP] European Pat. Off. ..... 86116472

[51] Int. Cl.[4] ..... A63C 7/10
[52] U.S. Cl. ..... 280/605; 188/8
[58] Field of Search ..... 280/604, 605, 809; 188/5, 8

[56] References Cited

U.S. PATENT DOCUMENTS 3,724,867 4/1973 Hawthorne ..... 280/605
3,899,184 8/1975 Haddad ..... 280/605
4,006,911 2/1977 Kraus et al. ..... 280/809

FOREIGN PATENT DOCUMENTS 2757942 6/1979 Fed. Rep. of Germany .
3523673 7/1986 Fed. Rep. of Germany .
2499418 8/1982 France .

*Primary Examiner*—David M. Mitchell
*Assistant Examiner*—Tamara L. Finlay
*Attorney, Agent, or Firm*—W. G. Fasse; D. H. Kane, Jr.

[57] ABSTRACT

The invention relates to a braking for installation on a snow ski. Such mechanisms are known, for example, in the form of a ski binding. The ski binding allows the movement of the ski with the foot. However, it is not possible to achieve a braking effect with parallel guided skis. Therefore, it is suggested to arrange at least one braking member on the ski for movement against the ground relative to the respective ski. The braking member is operatively connected with an operating mechanism to be actuated by the skier.

19 Claims, 5 Drawing Sheets

BRAKE FOR INSTALLATION ON A SNOW SKI

FIELD OF THE INVENTION

The invention relates to a mechanism for installation on a snow ski with at least one braking member forming a lever tiltable parallel to and opposite to the running direction and having a free end angled at least slightly toward the ground.

DESCRIPTION OF THE PRIOR ART

Various mechanisms are known which are arranged on a ski and which normally serve for connecting the skis with the ski boots. Today, such mechanisms have reached a high technical state of the art and are generally known under the name of "safety bindings".

It often occurs that especially beginners experience difficulties due to the arising acceleration, on narrow down-hill runs, icy gorges, steep slopes, precipitous cross-country tracks and other narrow runs. In order to reduce the travel speed the skier must place the skis in a symmetric angle position by means of heel pressure on both sides, whereby the ski tips must be held close together. This braking position is commonly known by the term "snowplow". The difficulty with this braking method lies in the bent position of the legs relative to the upright stature of the body, wherein the pelvis is held in a forced position leading to painful cramping during a prolonged "snow plowing". Moreover, especially the beginner is apt to lose control over the ski in such a braking configuration so that the ski tips cross over one another. This necessarily leads to a fall. Besides, the braking effect of this braking configuration is dependent upon the ability and the technique of the skier. Additionally, this braking configuration cannot be employed on a precipitous cross-country track nor can it be used in a diagonal run.

German patent publication (DE-OS) No. 2,757,942 discloses a mechanism of the above described type, which is very unstable and causes an undesirable braking effect by the beveled parts already in the non-operating state and requires a relatively large force for operating a tension cord. The tension cord itself is difficult to handle because it cannot comprise any handle. Since the hand necessary for operation also must hold the ski pole, the operation of the tension cord becomes almost impossible.

OBJECTS OF THE INVENTION

Starting from this situation it is the aim or object of the invention to provide a brake mechanism for installation on a snow ski which makes the use and practice of the previous braking technique superfluous, and which makes possible a braking maneuver in which both skis may extend in parallel to each other. The operation shall be simple and achievable with small forces.

SUMMARY OF THE INVENTION

These objects have been achieved by a mechanism according to the invention, wherein a tiltable fulcrum type lever is operatively connected with an operating mechanism of which the operating arm is tiltably arranged or journalled and extends at an angle to the braking lever arm or arms. The operating lever arm extends upwardly and forwardly at an angle to the horizontal and has an insertion opening extending approximately radially with respect to a journal or tilting axle having a rotational or tilting axis, whereby an angled end forming said braking lever arm of the tiltable lever is located above a contact plane, in its resting position on top of the ski. The angled end of the tilting lever forming said braking lever arm is working in effect, for example, like a brake shoe when moved against the ground by the tilting of the operating arm about said journal axis. A ski equipped with this braking member is decelerated by operating the braking member, that is, by pressing the angled end against the ground. The speed reducing element is now no longer the ski itself which heretofore had to be operated appropriately by the foot for a braking action. Rather, it is the described braking member which is operatively connected with an operating mechanism for moving the braking member against the ground so that the desired braking effect is achieved. The described arrangement is moreover so constructed that the braking mechanism cannot achieve any undesirable effect. Since the angled end lies above the contact plane on top of the ski in its resting position, any undesired braking effect worth mentioning is prevented. Moreover, the angle lever with the insertion opening allows the operation of the brake by means of the ski pole of which the tip or an auxiliary part attached in the area of the tip is inserted so that a long and comfortable operating lever is provided. The hands are not required to operate any other control element or operating element and may instead stay on the ski pole. Thus, an advantageous lever ratio for operating the brake is achieved simultaneously.

One embodiment of the invention provides that the tiltable lever and the operating mechanism are tiltably arranged on the same axle, whereby the construction of the mechanism is considerably simplified.

A further embodiment of the invention provides that the tiltable lever and the operating mechanism form a single rigidly interconnected structural component resulting in a further simplification in the manufacturing and mounting. Moreover, the susceptibility of the mechanism to wear is reduced by such an integral structure.

A further embodiment of the invention provides that the insertion opening comprises, at least partially, lengthwise grooves or rather flutes on the inner surface providing a positive guidance of the ski pole or the auxiliary member attached thereto.

According to a further embodiment of the invention it is suggested that the lever carries an exchangeably arranged braking bar, whereby the element subject to wear and tear is exchangeable and it is moreover possible to provide different forms of the braking bars for different applications.

As a supplementing detail of the invention it is also suggested that the braking bar is attached to the lever by a screw connection. Such a connection is easily manufacturable, secure and still allows a simple replacement of the braking bar.

According to a further embodiment of the invention it is provided that the bottom of the free end of the lever or bar comprises crosswise grooves or a crosswise serration at least in the angled area. The braking effect is thereby improved and a lighter load may be applied to the operating mechanism.

Another embodiment of the invention furthermore provides that each tiltable lever is arranged on a tilting axle and forms a single piece component with the operating mechanism. By these means a simple structure and simultaneously a high stability of the mechanism are achieved.

According to a further embodiment of the invention at least two braking members are provided. In this case a symmetric loading of the ski is achieved, especially if one braking member is provided on each side of the ski as suggested by a further embodiment of the invention. However, it is also possible to provide these braking members in different forms and in different angular positions so that when they are operated, for example, they are applied one after another.

The invention further provides that both braking members are in the form of tiltable members are arranged on a common tilting axle or shaft and forming an angle lever as a single structural component with a common operating mechanism. These means assure a simple operation, a simple production, and a high stability.

Furthermore, an embodiment of the invention provides that the ski pole guide has a widened form at least at an outer inlet region of the insertion opening, whereby the insertion of the ski pole tip or of an auxiliary member attached thereto is extraordinarily simplified.

A supplemental embodiment of the invention provides that the insertion opening comprises an insertion guide apron at its inlet area, which at least partially surrounds the insertion opening. This is a further simplification for the insertion of the ski pole. Insofar as the insertion opening only partly surrounds the insertion guide apron, the ski pole may even be placed against the side of the apron and then inserted using the apron as a guide.

A variation of the invention provides that the insertion guide apron is a single component with the operating mechanism. By these means a simple production and high strength is achieved and an accidental sliding away or twisting of the insertion guide apron is prevented.

It is furthermore suggested by the invention that the operating mechanism is cut-off at an angle at its upper end face in such a manner that the edge facing or closer to the skier is lower than the opposite edge further away from the skier. By these means the insertion of the ski pole tip or a corresponding auxiliary means is considerably facilitated.

It is further suggested by the invention that the insertion guide apron is curved outwardly and merges into the angled cut end face at its outer end region. This is an especially advantageous embodiment of the insertion guide apron because it simplifies the insertion.

The invention further provides a stop for establishing the initial position of the braking members or member and operating mechanism, whereby an unambiguous position is always established for the rest position out of which the operating mechanism may be operated. A misfitting failure position is thus prevented.

The invention also provides that the mechanism comprises an elastic element which forces and holds the braking member and operating mechanism into an initial position in their non-activated state, whereby upon removal of the operating force, the mechanism automatically returns into the initial position.

As a further improvement, the elastic element is a coil spring which is arranged coaxially with the tilting axis or axle. Such a coil spring may be space efficiently installed and does not require any costly structural measures for its arrangement.

Alternately, it is provided by the invention that the elastic element is a leaf spring of which one end is attached to a stationary member and of which the other end rests against the operating mechanism so that the latter is forced into the initial position. A leaf spring is similarly easy to install and remains functional even under icing conditions.

According to a further embodiment of the invention a base plate is attached to the upper surface of the ski. A mounting mechanism of the base plate carries at least one tilting axle, whereby at least one tiltable lever is arranged on the tilting axle. These features permit producing the entire mechanism completely independently of the ski so that the mechanism may be attached afterward to any ski.

According to a completing detail of the invention, it is provided that one end of a tilting axle protrudes beyond each of the two sides of the ski and a tiltable lever is attached to each respective protruding end. Due to the bilateral arrangement of the tiltable levers on a single tilting axle, an easy tiltability and secure attachment of the levers is achieved. The tilting axle itself may be simply and sufficiently securely attached directly to the ski or attached to the ski by means of an auxiliary member such as, for example, a base with an appropriate mounting mechanism.

Finally, it is suggested by the invention that the braking member or braking bar is widened at least on one side in the area intended for engaging the ground. By these means the braking effect for an application in loose snow or deep snow is improved.

BRIEF DESCRIPTION OF THE DRAWINGS

The invention shall now be more closely described in conjunction with the accompanying drawings which show example embodiments, wherein:

FIGS. 1 to 8 show various mechanisms according to the invention which are, however, similar in several essential components. FIG. 9 shows an auxiliary operating device.

Figure 8:
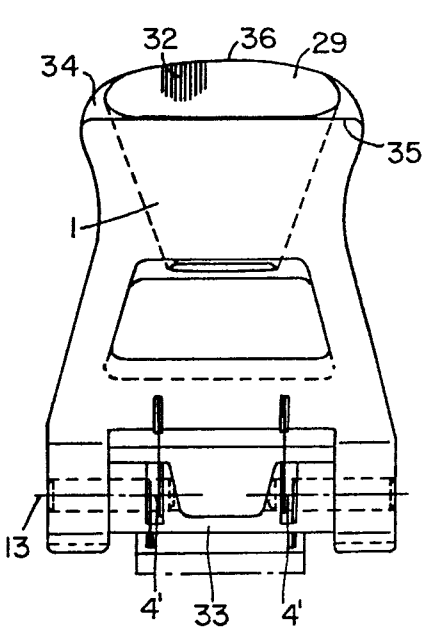
FIG. 8 is a view in the direction of arrow D in FIG. 7.

The mechanism according to the invention serves as a brake for a snow ski. The entire mechanism may be mounted on a ski, for example, in front of the binding. For this purpose the mechanism comprises a base plate 2 on which a mounting jig or carrier 22 is arranged in connection with the example embodiments according to FIGS. 1, 2, and 5, 6. In the example embodiment according to FIGS. 3, 4, the mounting carrier or jig is shown at 21 and in the case of FIGS. 7 and 8, the mounting carrier or jig is shown at 33. The mounting jig or carrier and the base plate may be embodied as a single piece structural component.

The base plate 2 is at most as wide as a ski 5 and is, for example, screwed onto the upper surface of the ski 5 in front of the binding. The ski 5 may be pre-equipped for such a screw attachment or generally for any attachment of the base plate 2.

The mounting carrier 21 or 22 or 33 comprises a bored hole in which a tilting axle or shaft 13 is arranged which protrudes respectively beyond the outer sides of the mounting carrier 21 or 22 or 33. An operating mechanism 8, 9, 10, or 28 in the form of a lever comprises two fork-shaped shanks reaching around the facing sides of the mounting carriers or jigs 21 or 22 or 33 respectively.

The above mentioned shanks comprise holes through which a journal or tilting axle or shaft 13 is stuck so that an operating mechanism 8, 9, or 10 or 28 in the form of a fulcrum type lever can tilt about the tilting or journal axis of the axle or shaft 13. In the initial or starting position an operating lever arm B may be oriented approximately 60° upward from the horizontal and toward the front. At least one brake-lever arm 23 of the fulcrum type lever extends approximately horizontally in said initial position.

Fork shaped shanks forming two brake lever arms 23, for example, extend at an angle to the operating lever arm B whereby each of these brake lever arms 23 is equipped with an exchangeable braking bar 3 at its bottom side. The exchangeability is made possible by means of a screw connection 12. The braking bar or brake shoe 3 and brake lever arm 23 together form the braking member 7. In order to improve the braking effect the braking bar 3 is slightly beveled or angled at its free end in a direction toward the ground 6. The lever arms 8 and 23 may also be in the form of a single piece tiltable lever 27 (FIG. 7) comprising a beveled or angled end 30.

As seen in the travel direction 11 at least the mounting carrier or jig 21 or 22 respectively along its front area comprises a sharp-edged corner which serves as a stop 20. During the circular arc motion which the operating mechanism 8, 9, or 10 or 28 carries out about the tilting axle or shaft 13 when it is operated, the inner surface 24 connecting the two lateral shanks with each other, comes into contact with the edge forming the stop 20 so that any further tilting motion is prevented.

The operating mechanism 8, 9, and 10, as well as 28 in the form of a flat lever comprises a slightly conical bored hole extending approximately perpendicularly to the tilting axle or shaft 13 and serving as a funnel type ski pole guide 1. The ski pole guide is widened in a direction toward the insertion opening 14 or 15 or 16 or 29 respectively. The ski pole guide comprises an insertion guide apron 17 or 18 or 19 or 37 respectively, at its outer end. While the insertion guide apron 17 completely encircles the ski pole guide 1 in the form of a bored hole thereby forming a widened hollow cone which opens into the ski pole guide 1; the insertion guide aprons 18, 19, and 37 only partly encircle the ski pole guide 1. By these means it is made possible to insert the ski pole tip into the ski pole guide 1 without problems. The example embodiments according to FIGS. 3, 4, and 5, 6 and 7, 8 allow a sideways swinging-in of the ski pole tip through the open area of the insertion guide apron until contacting the insertion guide apron 18 or 19 or 37 respectively, and a subsequent insertion of the ski pole tip into the ski pole guide 1.

If the brake mechanism is attached to a ski 5 then the mechanism may be operated by means of a tilting motion of the operating mechanism 8, 9, 10, or 28 in the direction of the arrow 25. For this purpose, the tip of the ski pole is inserted into the ski pole guide 1, whereupon the skier pulls the ski pole toward his body. Through this action angular positions of the operating mechanism 8, 9 or 10 or 28 respectively, as well as angular positions of the braking members 7 are caused as shown in the drawings by dash-dotted lines. Each braking member 7 thereby presses into the ground 6 for causing a corresponding braking effect. If the ski pole (not shown) is again pushed toward the front in the travel direction 11, the mechanism again returns into its initial position. This holds true correspondingly for the example embodiments according to FIGS. 7 and 8.

Figure 2:
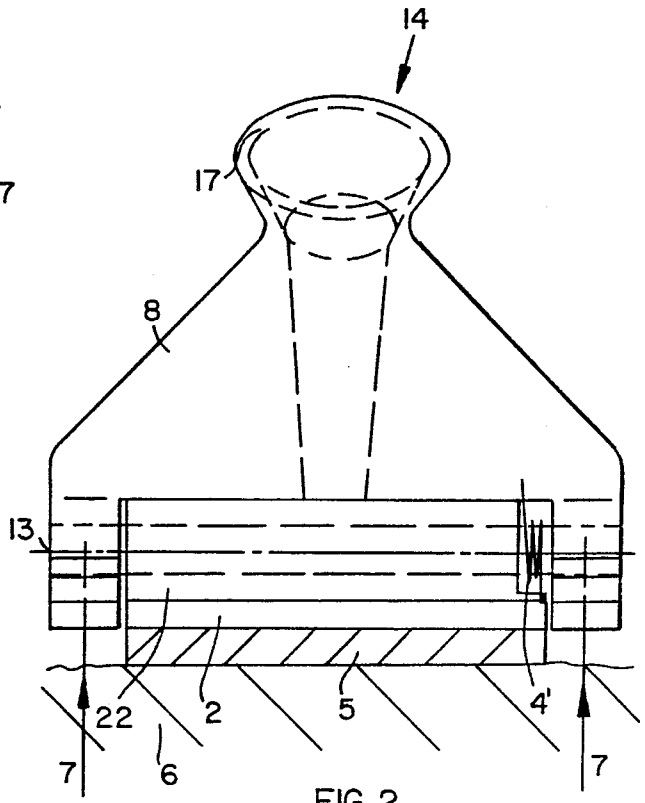
FIG. 2 is a view in the direction of arrow A in FIG. 1.
Figure 1:
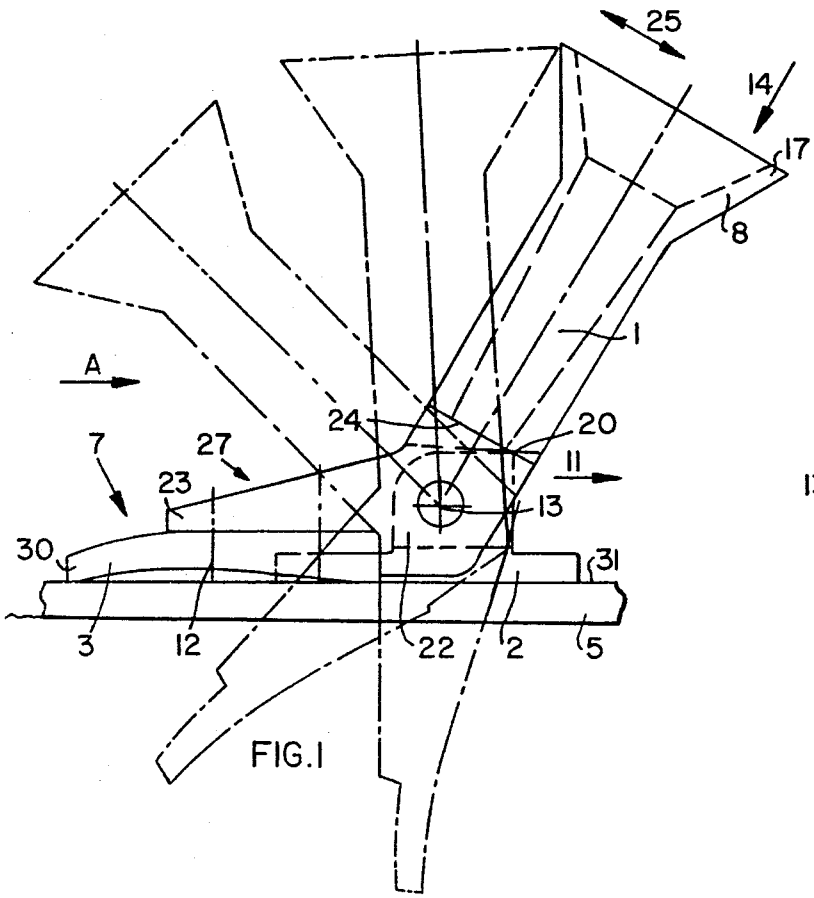
FIG. 1 is a side view of the present snow ski brake mechanism.
Figure 5:
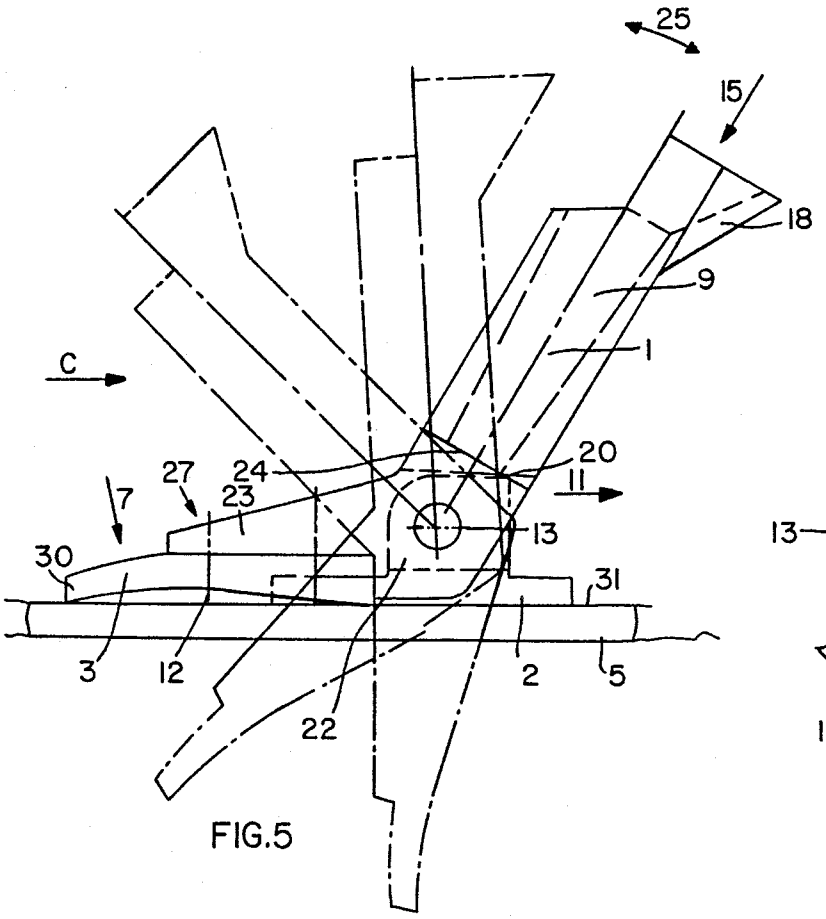
FIG. 5 is a side view of a further modified embodiment.
Figure 7:
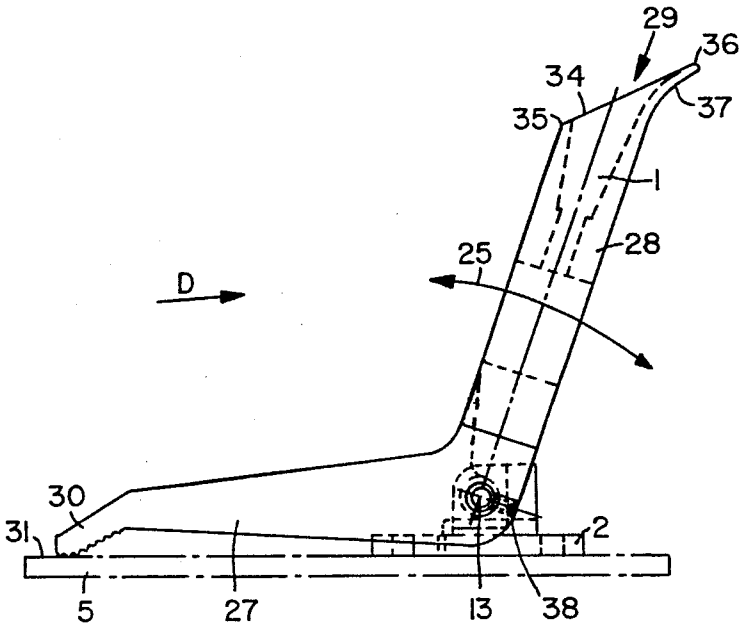
FIG. 7 is a side view of a another embodiment.

However, in order to achieve the initial position, for example, any operating mechanism 8, 9, or 10 or 28 may be, for example, preloaded by a spring. In the example embodiment according to FIGS. 1, 2, and 5, 6 as well as 7 and 8 at least one coil spring 4' is provided coaxially to the tilting axis 13. One end of the coil spring 4' rests against the base plate and on the other end rests against the operating mechanism 8 or 28, respectively, in the form of a lever. This coil spring 4' returns the operating mechanism 8 or 28 respectively and therewith any braking member 7 or 30 respectively attached to this operating mechanism back into the initial position. The initial position is shown in FIGS. 1, 5 and 7 as the position drawn with full lines.

Figure 4:
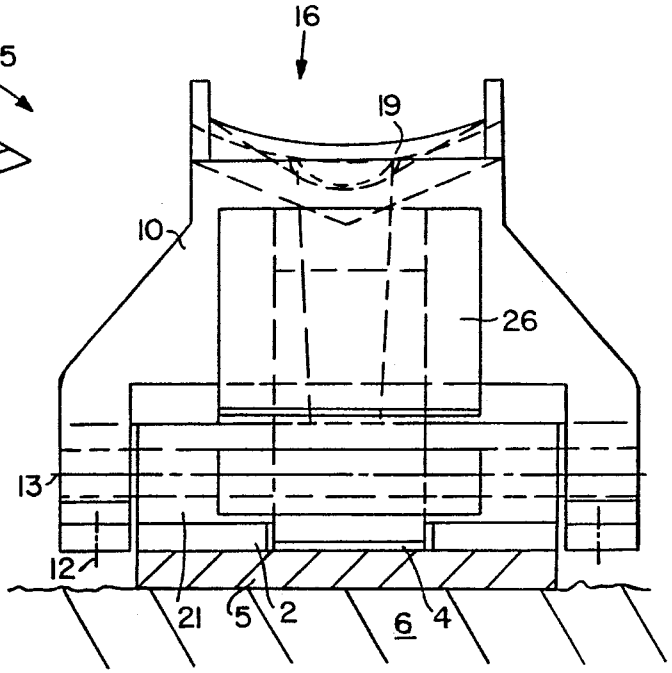
FIG. 4 is a view in the direction of arrow B in FIG. 3.
Figure 3:
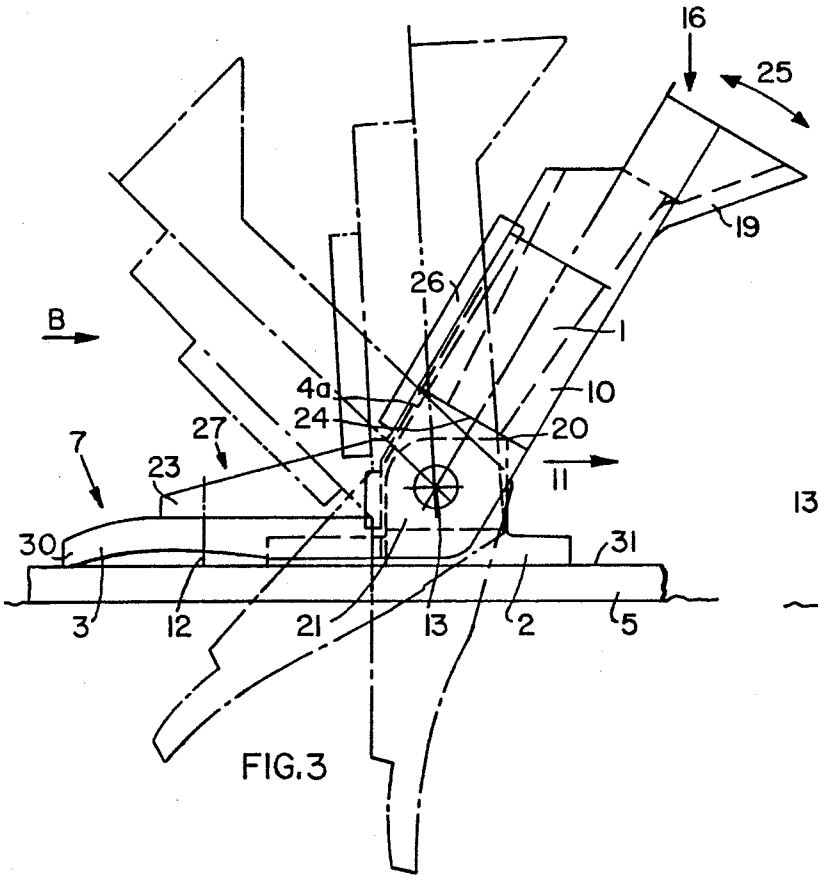
FIG. 3 is a side view of a modified embodiment.
Figure 6:
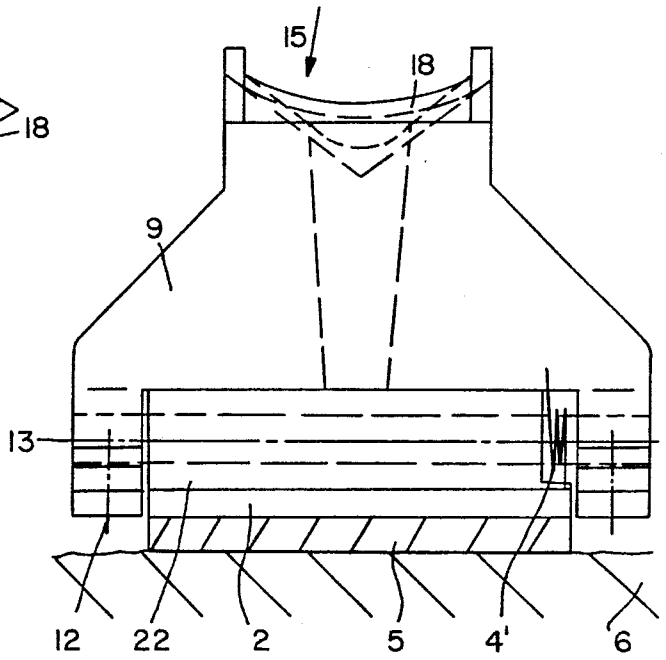
FIG. 6 is a view in the direction of arrow C in FIG. 5.

In the example embodiment according to the FIGS. 3, 4 a leaf spring **4*a* is provided as the elastic element. The leaf spring foot 4 of the leaf spring 4*a* is secured in the area of the base plate 2 and the leaf spring 4*a* further, for example, rests against the backside of the operating mechanism 10, whereby the leaf spring 4*a* has a shape such that it continually forces the operating mechanism 10 toward the initial or starting position. During the tilting motion of the operating mechanism 10 in the direction of the arrow 25, the leaf spring 4*a* must be free to slide along the backside of the operating mechanism 10. Therefore, it only leans or rests against the backside. However, in order to prevent injuries and damage, the leaf spring 4*a* is covered in this area by a cover plate 26** which does not hinder the movability of the leaf spring.

Figure 9:
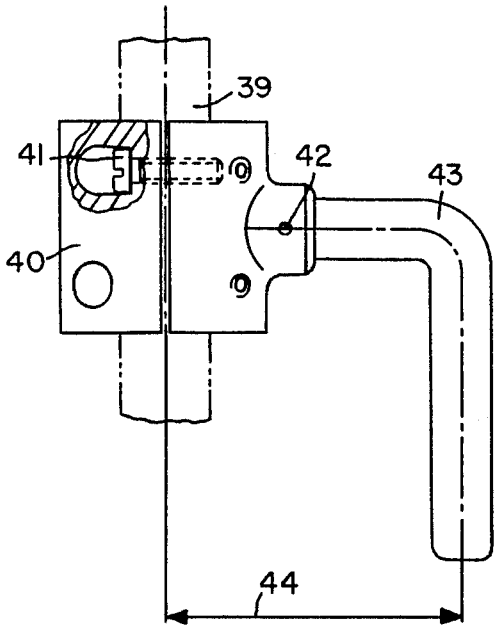
FIG. 9 is a side view of auxiliary brake operating device.

FIG. 9 shows an auxiliary means which is to be attached to the ski pole tip 39 for operating the braking mechanism according to the invention. A split clamping collar 40 is tightly clamped in the area of the ski pole tip 39 by means of the clamping screws 41. In the arrangement according to FIG. 9 the clamping collar 40 comprises a bent or elbowed insertion pin 43 of which the insertion end extends parallel to the ski pole tip 39 at a spacing distance 44 away from the ski pole tip 39. A cross pin 42 secures the insertion pin 43 to the clamping collar 40. Now, the end of the insertion pin 43 may be inserted into the opening of the braking mechanism provided for this purpose to operate the braking mechanism. The mechanism shown in FIG. 9 simplifies the insertion and operation. Simultaneously, the mechanism according to FIG. 9 in no way alters the handling of the ski pole.

The invention provides a simple mechanism for reliably braking a snow ski. It is not absolutely necessary that two braking members are provided for each ski and it is not absolutely necessary that these braking members are arranged at the sides of the ski. It is also conceivable to provide at least one braking member in an appropriate hole through the ski. It is also not absolutely necessary that the braking member and the operating mechanism are embodied as one structural unit or at least as one component. It is sufficient if both are operatively connected. Thus, for example, a mechanism is also conceivable in which the braking member is similarly tiltable about a tilting axis, but in which a cam lever or eccentric lever rests against the top of the braking member. The cam lever or eccentric lever may be similarly rotatably supported, whereby the braking member 7 is tilted by means of the eccentric or cam of this lever. Thus, the eccentric also is similarly operatively connected with the braking member.

Although the invention has been described with reference to specific example embodiments, it will be appreciated that it is intended to cover all modifications and equivalents within the scope of the appended claims.

I claim:

1. A brake mechanism for installation on a snow ski having a top surface and a bottom surface interconnected by two side surfaces, comprising mounting carrier means for securing said brake mechanism to said top surface, a fulcrum formed by said carrier means, lever means having two arms for transmitting a braking force to a level below said bottom surface, said fulcrum including journal means having a journal shaft for mounting said lever means intermediate said two arms to said carrier means for tilting about said journal shaft said two arms of said lever means including an operating lever arm and at least one brake lever arm having a brake end arranged for engaging the ground in a brake operated position and for assuming a resting position at a level at least above said bottom surface, said operating lever arm extending approximately radially relative to said journal axis and upwardly in a forward direction as viewed by a skier, said operating lever arm having an insertion opening means for inserting a brake operating member so that a skier can pull said brake operating member substantially in a horizontal direction opposite to said forward direction for rotating said operating lever arm about said journal shaft in an upward direction while simultaneously rotating said brake lever arm about said journal shaft in a downward direction for applying a braking force.

2. The brake mechanism of claim 1, wherein said operating lever arm and said brake lever arm of said lever means form one rigidly interconnected, integral structural unit.

3. The brake mechanism of claim 1, wherein said insertion opening comprises lengthwise flutes at least partially along its inner surface.

4. The brake mechanism of claim 1, further comprising a separate brake shoe, and means for exchangeably securing said brake shoe to said brake lever arm.

5. The brake mechanism of claim 4, wherein said securing means comprise a screw connection for exchangeably attaching said brake shoe to said brake lever arm.

6. The brake mechanism of claim 1, wherein said brake lever arm comprises ground engaging surface means having friction increasing means thereon for an improved braking action.

7. The brake mechanism of claim 1, wherein said lever means comprise a pair of brake lever arms forming a structural unit with said operating lever arm for operating said pair of brake lever arms by said operating lever arm in unison.

8. The brake mechanism of claim 7, wherein said journal means project outside said side surfaces, so that one brake lever arm of said pair of brake lever arms is located on one side of a ski and the other brake lever arm of said pair brake lever arms is located on the other side of a ski.

9. The brake mechanism of claim 8, wherein said journal means comprise a common journal shaft for said pair of brake lever arms constructed as a structural unit with said operating lever arm.

10. The brake mechanism of claim 1, wherein said insertion opening means forms a widened funnel type guide for the insertion of a ski pole as said brake operating member.

11. The brake mechanism of claim 10, wherein said insertion opening means comprises an inlet region forming an insertion guide apron which at least partially embraces an insertion opening.

12. The brake mechanism of claim 11, wherein said insertion guide apron is formed as one structural unit with said operating lever arm.

13. The brake mechanism of claim 12, wherein said operating lever arm has an upper end face cut at an angle to form a slant facing said skier.

14. The brake mechanism of claim 13, wherein said insertion guide apron has a curved outside, said insertion guide apron further having an outer end region merging into said angled cut upper end face.

15. The brake mechanism of claim 1, further comprising stop means for normally holding said lever means in said resting position.

16. The brake mechanism of claim 1, further comprising an elastic element arranged for normally holding said lever means in said resting position in a non-operated condition.

17. The brake mechanism of claim 16, wherein said elastic element is a coil spring arranged substantially coaxially with said journal shaft.

18. The brake mechanism of claim 16, wherein said elastic element is a leaf spring having a fixed end attached to said mounting carrier means and a free end resting against said lever means for normally holding said lever means in said resting position.

19. The brake mechanism of claim 1, wherein said mounting carrier means comprise a base plate attached to said top surface of said snow ski (5), said journal means being secured to said base plate.

* * * * *